US007827766B2

(12) United States Patent
Matsumoto

(10) Patent No.: US 7,827,766 B2
(45) Date of Patent: Nov. 9, 2010

(54) METHOD AND DEVICE FOR PACKAGING LOAD BODY

(75) Inventor: Ryozo Matsumoto, Fukuoka (JP)

(73) Assignee: Matsumoto System Engineering Co., Ltd., Fukuoka (JP)

( * ) Notice: Subject to any disclaimer, the term of this patent is extended or adjusted under 35 U.S.C. 154(b) by 1231 days.

(21) Appl. No.: 10/493,097

(22) PCT Filed: Oct. 22, 2002

(86) PCT No.: PCT/JP02/10922

§ 371 (c)(1),
(2), (4) Date: Apr. 20, 2004

(87) PCT Pub. No.: WO03/035481

PCT Pub. Date: May 1, 2003

(65) Prior Publication Data

US 2005/0016130 A1 Jan. 27, 2005

(30) Foreign Application Priority Data

Oct. 24, 2001 (JP) ..... 2001-326619

(51) Int. Cl.
*B65B 63/02* (2006.01)
*B65B 41/10* (2006.01)
*B65B 11/06* (2006.01)

(52) U.S. Cl. ..... 53/439; 53/173; 53/203; 53/436; 53/523

(58) Field of Classification Search ..... 53/170, 53/174, 203, 209, 436, 439, 441, 449, 523, 53/556, 588

See application file for complete search history.

(56) References Cited

U.S. PATENT DOCUMENTS

| | | | | |
|---|---|---|---|---|
| 3,815,649 | A * | 6/1974 | Delmar | 383/120 |
| 4,317,322 | A | 3/1982 | Lancaster et al. | |
| 4,592,193 | A | 6/1986 | Gustavsson | |
| 4,593,518 | A * | 6/1986 | Lancaster | 53/556 |
| 4,989,397 | A * | 2/1991 | Tomac et al. | 53/528 |
| 5,182,894 | A | 2/1993 | Bate | |
| 5,423,161 | A * | 6/1995 | Huson et al. | 53/449 |
| 6,138,557 | A * | 10/2000 | Brown et al. | 100/41 |

(Continued)

FOREIGN PATENT DOCUMENTS

DE 3335754 4/1985

(Continued)

*Primary Examiner*—Rinaldi I. Rada
*Assistant Examiner*—Gloria R. Weeks
(74) *Attorney, Agent, or Firm*—Wenderoth, Lind & Ponack, L.L.P.

(57) ABSTRACT

A bulk material is compacted from its bulk state into a rectangular parallelepiped so that it can readily be wrapped with stretch film. To this end, a stretch film is wrapped spirally around a cylindrical skirt section having an open end while the stretch film is being moved towards the open end of the skirt section, thereby forming a cylinder of such stretch film. While the cylinder of wrapped film is being moved further, a pressed load material is pushed out of the skirt section to push the pressed load material into the cylinder of wrapped film fed past the open end of the skirt section. The wrapped cylindrical film is severed at positions spaced from opposite ends of the load material covered therewith or is sealed at these opposite ends.

13 Claims, 18 Drawing Sheets

U.S. PATENT DOCUMENTS

| | | | | |
|---|---|---|---|---|
| 6,745,544 | B2 * | 6/2004 | Matsumoto et al. | 53/399 |
| 6,880,316 | B2 * | 4/2005 | Lancaster et al. | 53/588 |

FOREIGN PATENT DOCUMENTS

| | | |
|---|---|---|
| EP | 458889 | 11/1994 |
| JP | 53-61489 | 6/1978 |
| JP | 54-020859 | 7/1979 |
| JP | 55-019804 | 5/1980 |
| JP | 59-46845 | 11/1984 |
| JP | 8-508223 | 9/1996 |
| JP | 10-323798 | 12/1998 |
| JP | 2002-225807 | 8/2002 |
| WO | 94/22717 | 10/1994 |

* cited by examiner

METHOD AND DEVICE FOR PACKAGING LOAD BODY

TECHNICAL FIELD

The present invention relates to a load packaging method and apparatus for packaging a bulk load material such as a mass of wet feeding stuff or a mass of refuse or waste with a stretch film while pressing or compacting such a bulk load material.

BACKGROUND ART

Load packaging methods and apparatuses of this type have hitherto been known as disclosed in JP S59-46845 B and JP H08-508223 A.

In what are shown and described in the former of the above prior art references, a load material is placed on a conveyer whose upper and lower surfaces are driven to move in an identical direction and at an identical speed, and the load material carried on the moving conveyer is wrapped, together with the conveyer, with a stretch film of stretchable material. When the load material in this state is moved to a position beyond the downstream end of the conveyer where it comes off the conveyer, the stretch film is allowed to shrink, leaving only the load material wrapped therewith.

Also, the latter of the above prior art references describes its first form of implementation in which a load material placed on a first table is wrapped with a stretch film in a direction perpendicular to a horizontal direction. After this load material is moved onto a second table, the second table is turned horizontally about a vertical axis of rotation to further wrap the load material on the second table with a stretch film in a direction perpendicular to the direction in which the load material was wrapped on the first table with the stretch film.

The latter of the above prior art references also describes its second form of implementation in which a wrapping means is rotated in a horizontal plane and a load material is rotated about a horizontal axis of rotation, namely in a vertical plane so that rotating the wrapping means while the load material is being rotated causes the load material to be wrapped both vertically and horizontally.

Both of these prior art references require, however, that a load material to be wrapped with a stretch film or films be pre-consolidated (e. g., into a carton shape or the like rectangular parallel piped), and thus are totally unsuitable to package a bulk material such as a mass of wet feeding stuff or a mass of refuse or waste without a hitch.

A first object of the present invention is, therefore, to provide a load packaging method and apparatus whereby a bulk material to be packed such as a mass of wet feeding stuff or a mass of refuse or waste can be compressed or consolidated into a rectangular parallelepiped so that it can readily be wrapped with stretch film.

Also, what is shown and described in the former of the above prior art references allows a stretch film to be wrapped around a load material only about its horizontal axis and hence is unsuitable to package a cubic load.

On the other hand, what is shown and described in the latter of the above prior art references allows a stretch film to be wrapped around a load material about both its horizontal and vertical axes. In its first form of implementation, however, wrapping a load material in turn on two tables, first on a first table and then on a second table, with stretch films in two directions different from each other requires a roll of film to be tilted by 90 degrees, and requires the second table to be rotated before completing the wrapping operation. The inconveniences have therefore been encountered there, too. In particular, not only is the double wrapping operation cumbersome, but also the apparatus for performing this operation becomes complicated in mechanism.

Also, while this second form of implementation allows a load material staying at a given position to be doubly wrapped with stretch films about both its vertical and horizontal axes, this technique, too, has been found inconvenient in that it necessitates a complicated and large-scaled apparatus makeup because of the need for separate mechanisms for wrapping stretch film around the load material about both its vertical and horizontal axes, respectively.

A second object of the present invention is, therefore, to provide a load packaging method and apparatus whereby a pressed load material for packaging can simply be wrapped over its entire peripheral surfaces with stretch film only by wrapping the load material only about its one axis with either stretch film alone or both stretch and subsidiary films whereby a highly water-tight package is obtained without water soaking into or out of its inside.

SUMMARY OF THE INVENTION

In order to achieve the first object mentioned above, there is provided in accordance with the present invention a load packaging method which comprises the steps of: wrapping a stretch film spirally around a cylindrical skirt section having an open end while moving the stretch film towards the open end of the skirt section, thereby forming a cylinder of such stretch film; while this cylinder of wrapped film is being moved further, pushing a pressed load material out of the skirt section to push the pressed load material into the cylinder of wrapped film fed past the open end of the skirt section; and severing the wrapped cylindrical film at positions spaced apart from opposite ends of the pressed load material covered therewith.

The present invention also provides an apparatus for carrying out the above load packaging method, which apparatus comprises: a press cylinder having a cylindrical skirt section with an open end; a press means for axially pressing a load material charged into the press cylinder and pushing the pressed load material forwards out of the open end of the skirt section; a plurality of film feed conveyers disposed at a plurality of sites around the skirt section, respectively, and adapted to move axially thereof towards its open end; a ring shaped wrapping means disposed exterior of the skirt section for wrapping a stretch film around the skirt section orthogonally to an axis of the skirt section and exteriorly of the film feed conveyers whereby the stretch film is wrapped while forming a cylinder thereof; and a cutting means disposed ahead of the open end of the skirt section for acting on the wrapped cylindrical film fed from the open end of the skirt section to sever the film at a position spaced from the open end of the skirt section.

In the invention described above, first a bulk load material to be packed is compacted by the press means. In parallel to this, the ring shaped wrapping means is operated when the film feed conveyers are brought into operation to wrap a stretch film around the skirt section from exterior of the film feed conveyers, thereby permitting the wrapped film to move towards the open end of the skirt section while forming a cylinder thereof. And, when fed to ahead of the open end of the skirt section, the forward end of the wrapped film is freed from restraint by the skirt section and allowed to deform while reducing its diameter according to the shrink characteristics of stretch film, whereby a state ready to commence wrapping the load material is reached.

In this state, the load material compacted by the press means is quickly fed to a position at which it in part protrudes from the open end of the skirt section and then is pushed out to ahead of the cutting means at a speed synchronous to that of the film feed conveyers. The compacted load material is then pushed out of the skirt section into the cylindrical wrapped film leaving the skirt section while being covered with this cylindrical wrapped film. And, when the covered load material reaches ahead of the cutting means, the press plate is moved back. Thereafter, a portion of the film lying between the rear end of the covered load material and the skirt section is cut off by the cutting means. The cut off ends of covering film each deform while reducing its cylinder diameter by being freed from tension and by being melted and cut off with a heated wire. In this state, the film feed conveyers and the ring shaped wrapping means are stopped to be in a state ready to commence a next wrapping operation for load material.

In this manner, the compacted load material when pushed out of the skirt section of the press cylinder is pushed into and covered with the cylinder of the film wrapped around the skirt section and fed out of the skirt section.

It is thus possible to package a load material in the form of bulk such as feeding stuff or refuse/waste with stretch film upon compacting the material into a rectangular parallelepiped from its bulk state.

In order to achieve the second object mentioned above, there is provided in accordance with the present invention a load packaging method which comprises the steps of: wrapping a stretch film spirally around a cylindrical skirt section having an open end while moving the stretch film towards the open end of the skirt section, thereby forming a cylinder of such stretch film; while the cylinder of wrapped film is being moved further, pushing a pressed load material out of the skirt section to push the pressed load material into the cylinder of wrapped film fed past the open end of the skirt section; and sealing the wrapped cylindrical film at opposite ends of the pressed load material covered therewith.

The method mentioned above may include the steps of feeding subsidiary films from at least two opposed peripheral sites on a cylindrical skirt section having an open end towards the open end of the skirt section and wrapping a stretch film spirally around the skirt section from an exterior of the subsidiary films while moving the stretch film together with the subsidiary films towards the open end of the skirt section, thereby forming a cylinder of the stretch film and subsidiary films.

The present invention also provides an apparatus for carrying out the load packaging method mentioned above, which apparatus comprises a press cylinder having a cylindrical skirt section with an end open; a press means for axially pressing a load material charged into the press cylinder and pushing the pressed load material forwards out of the open end of the skirt section; a plurality of film feed conveyers disposed at a plurality of sites around the skirt section, respectively, and adapted to move axially thereof towards its open end; a ring shaped wrapping means disposed outside of the skirt section for wrapping a stretch film around the skirt section orthogonally to an axis of the skirt section and outside of the film feed conveyers whereby the stretch film is wrapped while forming a cylinder thereof; and a press cylinder blocking and unblocking door means disposed to coincide in position with the open end of the skirt section and having a pair of doors for closing the open end of the skirt section therewith, the doors having at their ends which are opposed to each other a sealing and a cutting means for sealing the wrapped cylindrical film fed from the open end of the skirt section and severing the film at its sealed area.

The load packaging apparatus mentioned above may further include at least two subsidiary film feeder means disposed on at least two diametrically opposed peripheral areas on the skirt section, respectively, for feeding subsidiary films along these areas of the skirt sections towards its open end.

In the load packaging apparatus mentioned above, the two doors in the press cylinder blocking and unblocking door means are adapted to move transversely to the open end of the skirt section and to close the open end with their surfaces on the side of the press cylinder wherein each of the halves of the open end of the skirt section is slightly slanted so that its side closer to the door end in its open state somewhat recedes from its side closer to the door in its closed state, and the respective surfaces of the doors in the press cylinder blocking and unblocking door means are each slightly slanted so they conform in inclination with those halves of the open end of the skirt section, respectively.

In the invention described above, the ring shaped wrapping means is operated when the film feed conveyers are brought into operation to wrap a stretch film around the skirt section from outside of the film feed conveyers, thereby permitting the wrapped film to move towards the open end of the skirt section while forming a cylinder thereof. And, the press cylinder blocking and unblocking door means is operated to seal and sever a portion of the wrapped film then ahead of the open end of the skirt section. A state ready to commence wrapping a load material is then reached.

Now, the operations of the film feed conveyers and the ring shaped wrapping means are suspended, and a press plate is driven to push a load material into the skirt section of the press cylinder with its open end closed by the press cylinder blocking and unblocking means and then to press the load material therein.

When an amount of the load material accumulates in the skirt section, the press cylinder blocking and unblocking door means is operated to open the doors. Then, the film feed conveyers and the ring shaped wrapping means are allowed to restart their operations to permit the wrapping film to continue to be wrapped about the skirt section while the pressed load material is pushed out of the skirt section with the press plate at a speed synchronous or commensurate with that of the film wrapping speed.

This allows the pressed load material while being pushed out of the skirt section to be pushed into and covered with the cylindrical wrapped film. When the covered load material pushed out reaches a position spaced from the skirt section by a distance, the press plate is moved back and then the press cylinder blocking and unblocking door means is operated to close the doors, thereby permitting a portion of the wrapped film that lies just behind the covered load material to be sealed and cut off. Thereafter, the operations of the film feed conveyers and the ring shaped wrapping means are suspended and a state ready to commence a next wrapping and packaging operation for load material is then reached.

In this manner, a pressed load material when pushed out of the skirt section is pushed into and covered with a cylinder being formed of the film wrapped around the skirt section and being fed from the skirt section. And, with the wrapped film sealed at its opposite ends, the pressed load material is packaged with the film over its entire surfaces.

And, in the operations mentioned above, the subsidiary films fed along the peripheral areas on the skirt section form the wrapping along with the stretch film and at their respective opposite ends are sealed along with the stretch film.

These subsidiary films thus serve to reinforce wrapping of a pressed load material at its longitudinal axial ends.

In this manner, a load material pressed and pushed out for packaging can simply be wrapped and hence packaged over its entire peripheral surfaces with a wrapping stretch film only by wrapping the pressed load material only about its one axis, namely around a direction in which it is pushed out, with either stretch film alone or both stretch and subsidiary films.

And, the cylindrical wrapped film with which a pressed load material is covered is sealed at its opposite ends whereby a highly water-tight package is obtained without water soaking into or out of its inside.

Also, in the operations mentioned above, the structural feature that each of the halves of the open end of the skirt section is slightly slanted so that its side closer to the end of each door in its open state somewhat recedes from its side closer to the end of each door in its closed state and the respective surfaces of the doors on the side of the press cylinder, in the press cylinder blocking and unblocking door unit are each slightly slanted so they conform in inclination with those halves of the open end of the skirt section, respectively, allows the respective surfaces of the doors to come into intimate contact with those halves of the open end of the skirt section immediately before the door closure terminates and to detach from the open end of the skirt section immediately after the doors begin to be opened. Therefore, the wrapped film is prevented from being damaged by the door closing and opening operations. Also, with the closed doors brought into pressure contact with the open end of the skirt section, the open end of the skirt section can be closed at its open end with the doors at an enhanced tightness.

Further, an apparatus as mentioned above for carrying out a method in accordance with the present invention requires only a component whereby wrapping film is wrapped around a pressed load material pushed out of a skirt section of a press cylinder and about a direction in which it is pushed out and a component whereby the wrapped film is sealed and severed at the front and rear of the pressed load material in the direction of pushing out the load material, both the components being disposed in a region of the open end of the skirt section. It thus permits simplifying the entire makeup of the equipment required to package a load material.

DETAILED DESCRIPTION OF THE INVENTION

Figure 1:
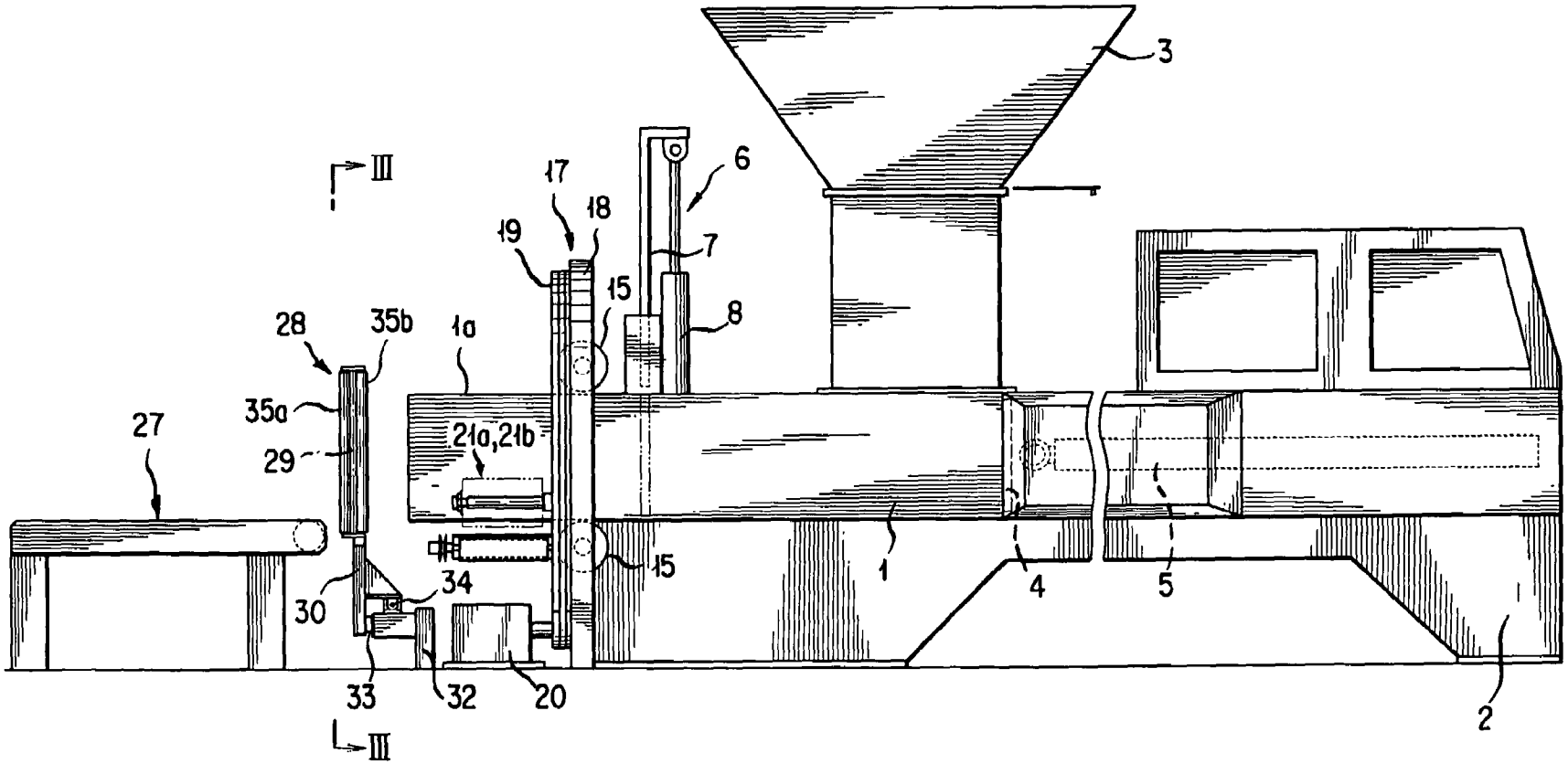
FIG. 1 is a side elevational view, in part broken, illustrating a first form of implementation of the load packaging apparatus according to the present invention.
Figure 2:
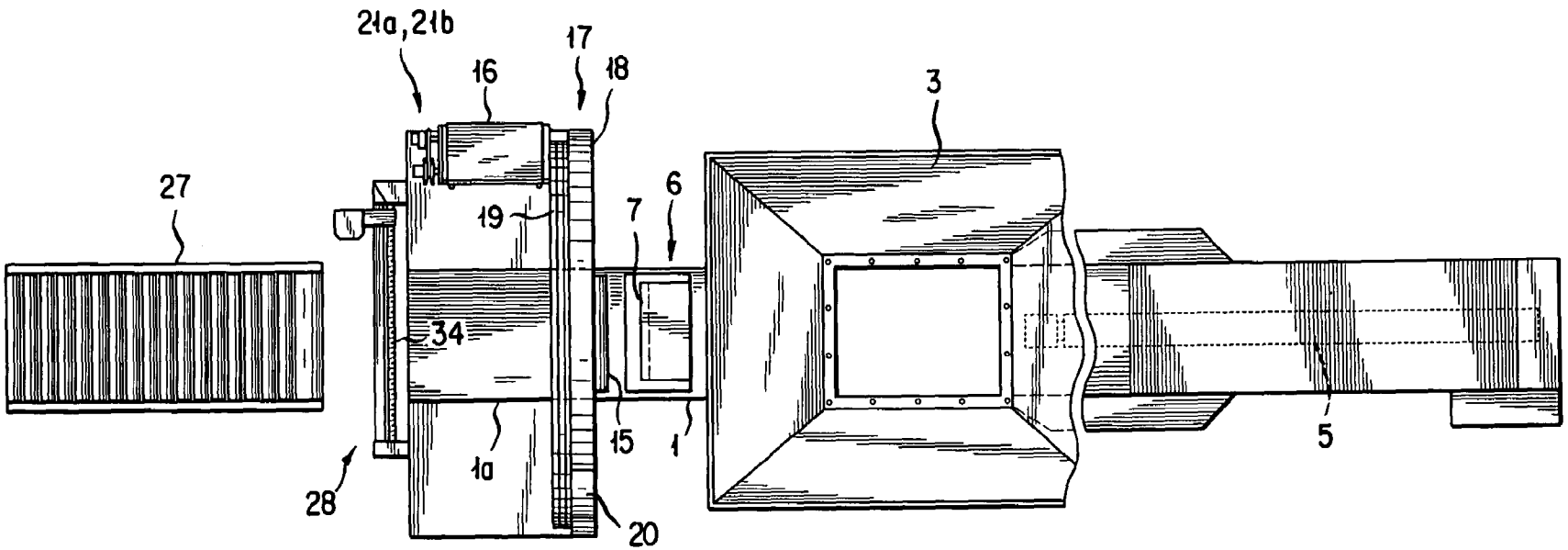
FIG. 2 is a top plan view, in part cut away, illustrating the apparatus in the first form of implementation of the invention.

Referring now to FIGS. 1 through 10, an explanation is given of an apparatus according to a first form of implementation of the present invention. In FIGS. 1 and 2, a press cylinder 1 is shown horizontally mounted on a pedestal 2 and shaped to be essentially square in cross section and having its first end open. A hopper 3 is disposed above a base of the press cylinder 1. The press cylinder 1 has a press plate 4 slidably disposed therein. Disposed behind the base of the press cylinder 1, a cylinder unit 5 is connected to the rear of the press plate 4 to cause the press plate 4 to reciprocate between a position behind an opening of the hopper 3 to the press cylinder 1 and a position in front of its open end and of a cutting unit 28 to be described later.

The press cylinder 1 is provided at its midway point with a press cylinder blocking and unblocking door unit 6. This press cylinder blocking and unblocking door unit 6 comprises a door sheet 7 adapted to be moved down into the press cylinder 1 to block it and a lift cylinder 8 for moving the door sheet 7 up and down.

Figure 4:
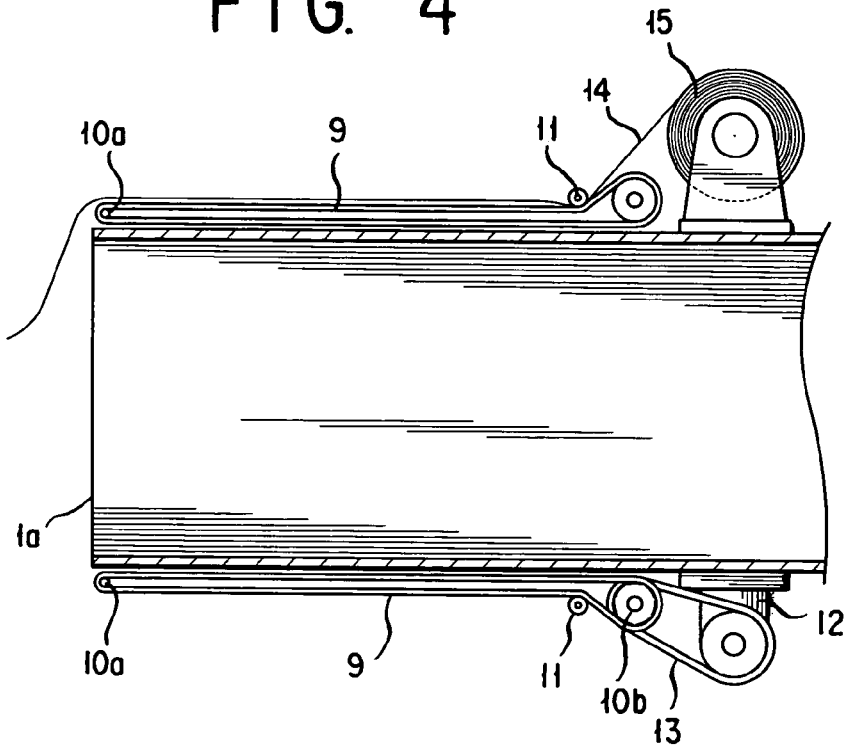
FIG. 4 is a cross sectional view of a portion of the apparatus taken along the line IV—IV in FIG. 3.

Seen in front of the press cylinder blocking and unblocking door unit 6 is a skirt section 1*a* of the press cylinder 1, which as shown in FIG. 4 has film feed conveyers 9 disposed on its four corner ridges, respectively, each over its full length, and each of the film feed conveyers 9 is wound in a loop over a pair of rotary wheels 10*a* and 10*b* supported by the skirt section 1*a*. Each film feed conveyer 9 is guided by the front side rotary wheel 10*a* and the rear side rotary wheel 10*b* and also by a guide wheel 11 disposed adjacent to the latter so that one half of its loop runs adjacent to the outer wall of the skirt section 1*a* and both halves of the loop extend essentially parallel to the skirt section 1*a*. The rear side rotary wheel 10*b* is coupled to the drive shaft of a drive motor 12 via a chain belt 13. Thus, all the film feed conveyers 9 are designed to have their loop outer halves running synchronously with one another and axially of the skirt section 1*a*. The film feed conveyers 9 may be driven by a common drive unit, or may be driven by four drive units, respectively.

Mounted above and below a base of the skirt section 1*a* of the press cylinder 1 and supported thereby are film rolls 15 and 15 from each of which a subsidiary film 14 having a width essentially identical to a side width of the skirt section 1*a* is to be unrolled and fed towards the end of the skirt section 1*a*.

Figure 3:
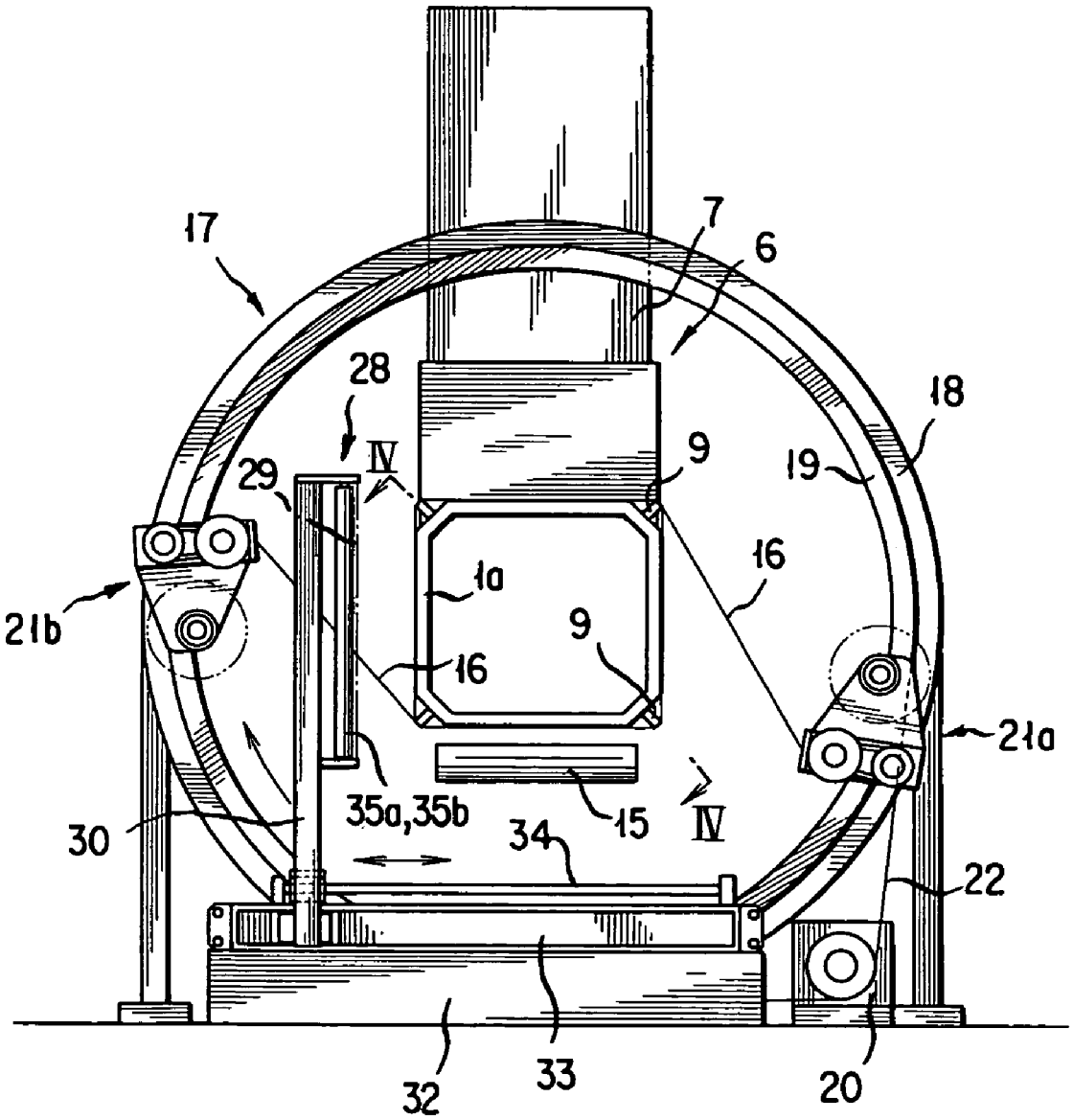
FIG. 3 is a side view of the apparatus as viewed in the direction of the arrows III—III in FIG. 1.

Disposed so as to surround the skirt section 1*a* as shown in FIG. 3 is a ring shaped wrapping unit 17 for wrapping a stretch film 16, together with the subsidiary films 14 carried from the film rolls 15, 15 by the film feed conveyers 9, around the skirt section 1*a*.

The ring shaped wrapping unit 17 comprises a ring frame 18 providing an axis of rotation essentially coaxial with the longitudinal axis of the skirt section 1*a*, a rotary ring 19 rotatably supported by the ring frame 18, a drive motor 20 for rotationally driving the rotary ring 19, and a pair of film feeders 21*a* and 21*b* attached to the rotary ring 19 at diametrically opposite positions thereon.

Such a ring shaped wrapping unit 17 has been known per se, wherein the rotary ring 19 is adapted to be rotated by the drive motor 20 via a belt 22.

Figure 5:
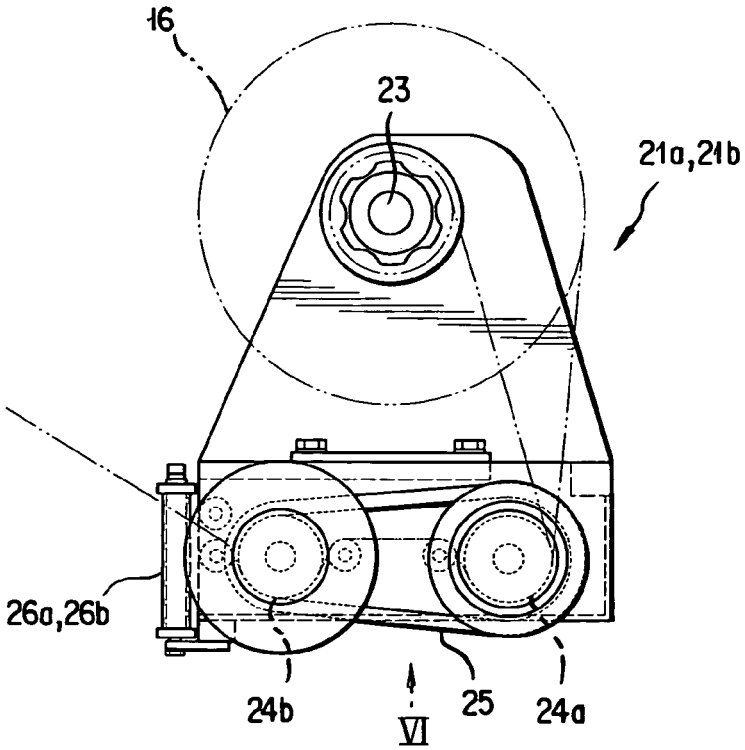
FIG. 5 is a front view of a film feeder.
Figure 6:
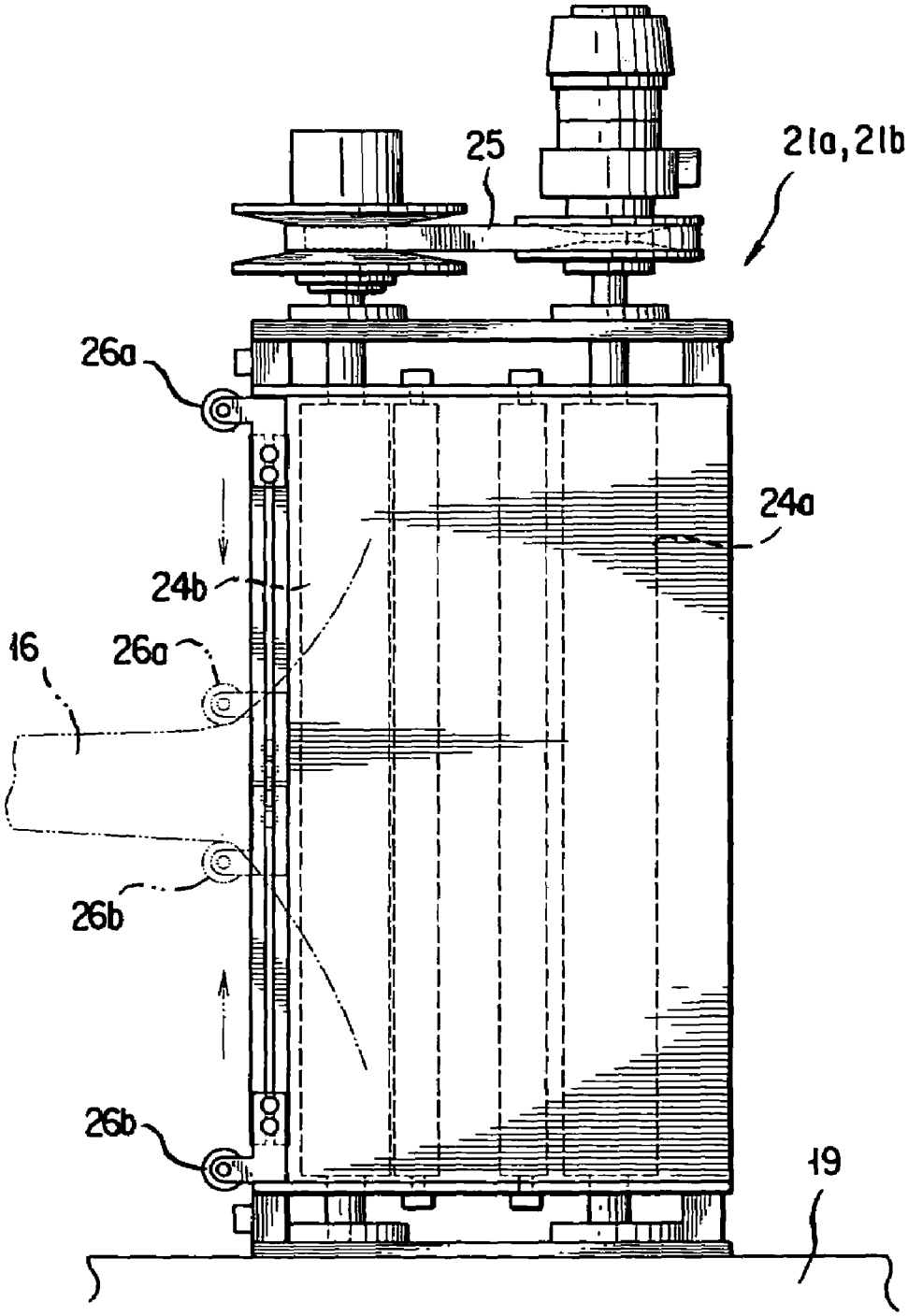
FIG. 6 is a view of the film feeder as viewed in the direction of the arrow VI in FIG. 5.

As shown in FIGS. 5 and 6, each film feeder 21*a*, 21*b* includes a film supporting shaft 23 for supporting a roll of stretch film 16, and a pair of draw rollers 24*a* and 24*b*. Here, the stretch film 16 is unrolled from the roll supported by the film supporting shaft 23 and is fed via the two draw rollers 24*a* and 24*b*. The two draw rollers 24*a* and 24*b* are rotated by the stretch film 16 being pulled out, and a difference in speed of rotation then caused between the two rollers 24*a* and 24*b* applies a strong stretching force to the film. In order to produce such a difference in speed of rotation, the two draw rollers 24*a* and 24*b* are coupled to a belt 25 via pulleys varying in diameter, and are rotated in an identical direction.

In addition, at least one of the two film feeders 21*a* and 21*b* is provided at the feed-out side of the outlet side draw roller 24*b* with a pair of mutually opposed squeeze rollers 26*a* and 26*b* which are positioned so that the spacing between them can be adjusted as desired at opposite sides of the width of the stretch film 16 being fed out. By these squeeze rollers 26*a* and 26*b* it is possible to change the width of the stretch film 16 being fed out of the film feeder 21*a*, 21*b*.

Referring back to FIGS. 1 and 2, disposed at a position spaced apart from the open (first) end of the press cylinder 1 is a conveyer stand 27 for accepting a packaged load pushed out of the press cylinder 1 and for forwarding it downstream. The cutting unit 28 mentioned before is disposed between the conveyer stand 27 and the open end of the press cylinder 1.

The cutting unit 28 is constructed as shown in FIGS. 1 to 3. It cuts the stretch film 16 between successive packaged load materials while the materials are being pushed out of the open end of the press cylinder 1 onto the conveyer stand 27. In the form of implementation illustrated, the cutting unit 28 is designed to use a heater wire 29.

To wit, the heater wire 29 is set taut between fingers of a cutter arm 30. The cutter arm 30 is supported by a frame 32 via a rodless cylinder 33 and a guide rod 34 so that it can be moved in a direction orthogonal to the axis of the press cylinder 1. A pair of guide rollers 35*a* and 35*b* are rotatably mounted across opposite sides of the heater wire 29.

A load packaging method using a load packaging apparatus constructed as mentioned above will be described below with reference to FIGS. 7A and 8B.

Figure 7A:
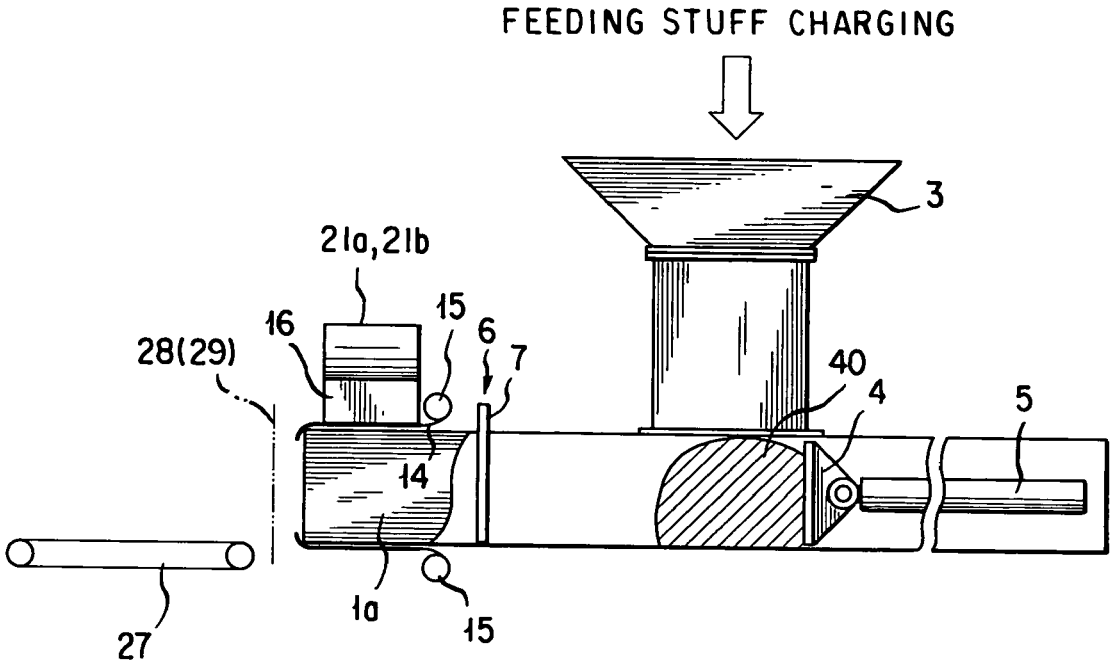
FIGS. 7A to 8B are explanatory views illustrating operations of the apparatus according to the first form of implementation of the present invention.
Figure 7B:
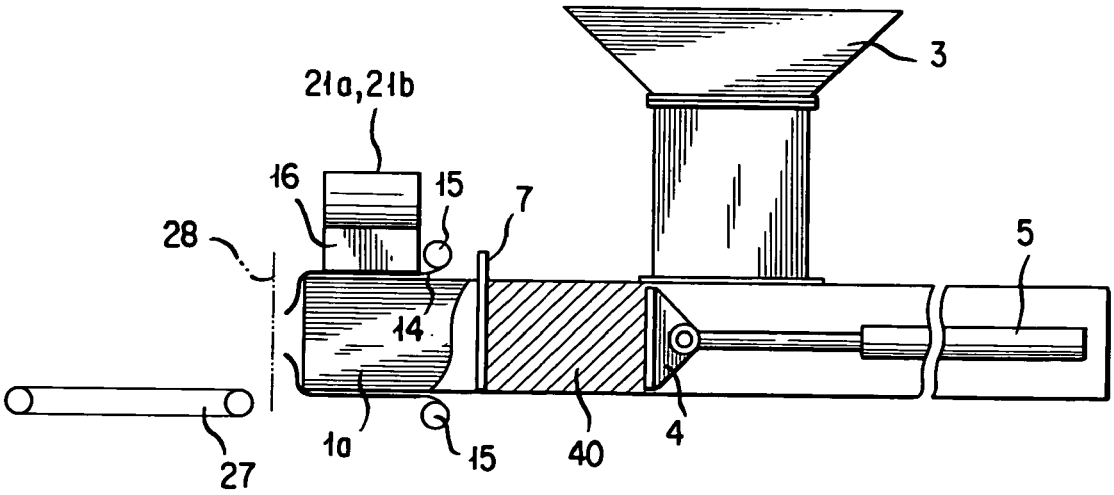

First, as shown in FIG. 7A the press cylinder 1 is blocked with the door sheet 7 in the press cylinder blocking and unblocking door unit 6 and then charged by means of the hopper 3 with a load material 40 such as feeding stuff in the form of a bulk mass. Simultaneously therewith, as shown in FIG. 7B, the cylinder unit 5 is operated to reciprocate the press plate 4, thereby compressing the load material 40 against the door sheet 7.

In parallel with the above, the film feeding conveyers 9 are operated to pull out the subsidiary films 14 along upper and lower surfaces of the skirt section 1*a* while the ring shaped wrapping unit 17 is operated to cause the film feeders 21*a* and 21*b* to turn around the skirt section 1*a* so as to wrap stretch film 16 spirally around the skirt section 1*a*, from above (outside of) the subsidiary films 14. This causes a continuous cylinder of film made of the subsidiary and stretch films 14 and 16 to form around the skirt section 1*a* and to be moved forwards by the film feeding conveyers 9. When advanced beyond the open (first) end of the skirt section 1*a*, the forward end of the continuous cylinder of film is freed from restriction by the skirt section 1*a* and thereby deformed, reducing its diameter according to shrink characteristics of the stretch film 16.

Figure 8A:
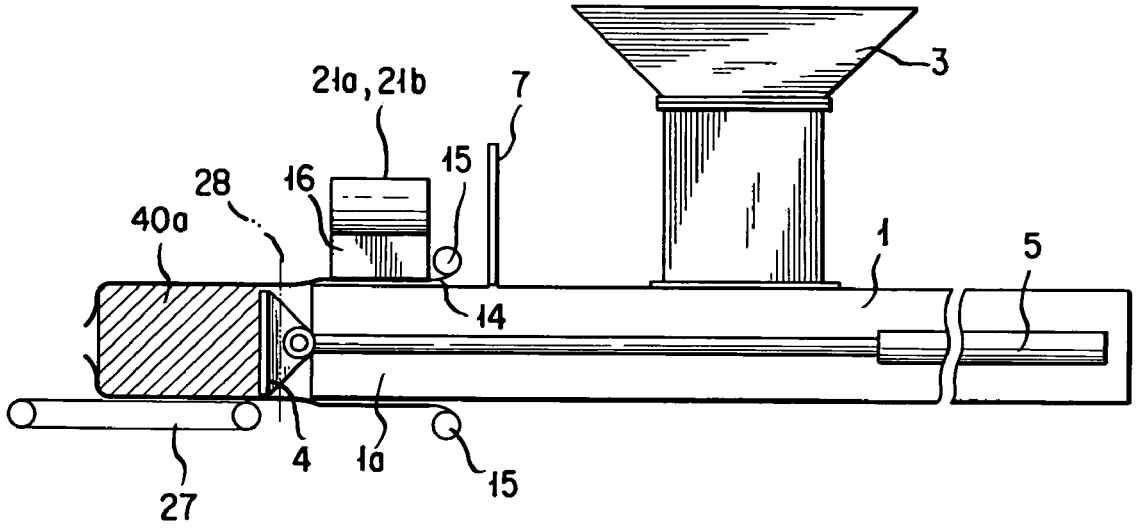
Figure 8B:
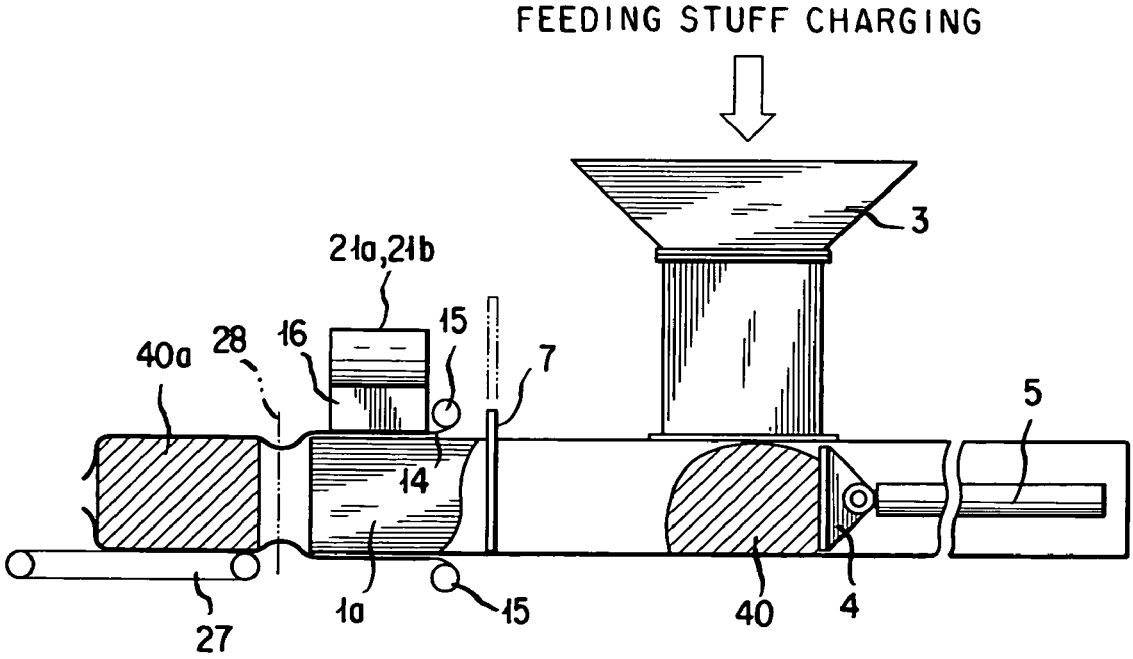

The door sheet 7 in the door unit 6 is opened in this state to unblock the press cylinder 1, and the press plate 4 is moved forwards rapidly to advance the compressed load material 40 to a position such that a portion thereof protrudes from the skirt section 1*a*. Then, the compressed material or a compact bundle 40 is further moved synchronously in speed with the speed of the film conveyer 9 and pushed out in front of the cutting unit 28 as shown in FIG. 8A. The compressed material or compact bundle 40 pushed out of the skirt section 1*a* is then pushed onto the conveyer table 27 while being covered with the wrapping made of the subsidiary and stretch films 14 and 16 wrapped around it to become a wrapped load material 40*a*. Thereafter, namely when the wrapped load material 40*a* is pushed in front of the cutting unit 28 onto the conveyer table 27, the press plate 4 is moved backwards.

In this state, the wrapping that is left cylindrical between the rear end of the wrapped load material 40*a* and the open end of the skirt section 1*a* is severed by the cutting unit 28. The severed ends of the wrapping each deform while reducing its cylinder diameter by being freed from tension and by being melted and cut off with the heated wire.

Figure 9:
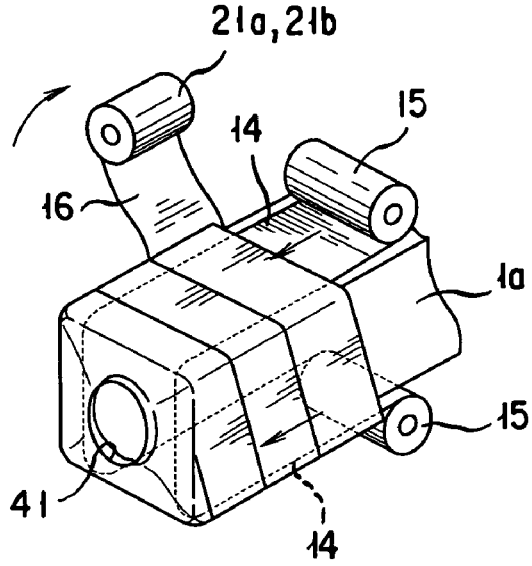
FIG. 9 is an explanatory view illustrating a manner in which to wrap a load material with wrapping films comprising a stretch film and subsidiary films.

The skirt section 1*a* is wrapped with the subsidiary and stretch films 14 and 16 in a manner as shown in FIG. 9.

Figure 10:
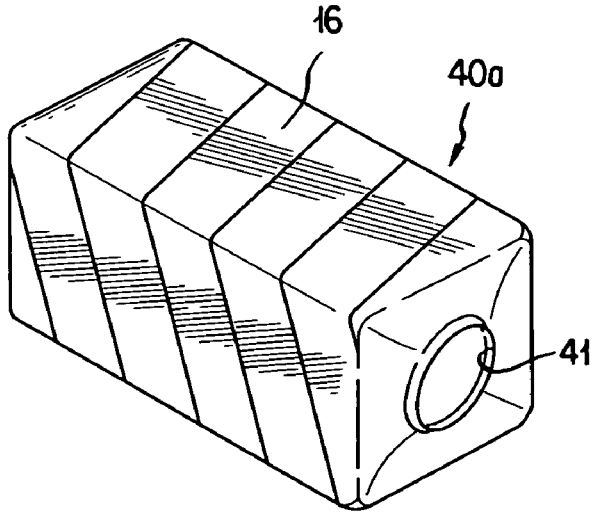
FIG. 10 is a perspective view illustrating the load material wrapped with the wrapping films.

The operations mentioned above terminate wrapping a single load material 40 which is wrapped to yield a wrapped body 40*a* as shown in FIG. 10, which in turn is discharged onto the conveyer table 27. The wrapped body 40*a* as shown is a body which is covered with the wrapping made of the subsidiary and stretch films 14 and 16 and whose periphery about its longitudinal axis is thereby caused to shrink. Each of both end faces of the wrapped body 40*a* has been tightly wrapped with the wrapping except for its central area 41 that is cylindrically open and smaller in size as formed by the diameter reducing deformation mentioned above.

In the first form of implementation of the invention described above, the skirt section 1*a* may be covered with subsidiary films 14 not only along two opposed surfaces which are its upper and lower surfaces as shown, but also along three or four side surfaces which are its upper, lower, and right and/or left hand side surfaces. Further, the subsidiary films 14 may be of cloth. Yet further, these subsidiary films 14 may be omitted altogether if the packaging strength is not much essential or if a number of stretch films 16 are used.

Figure 11:
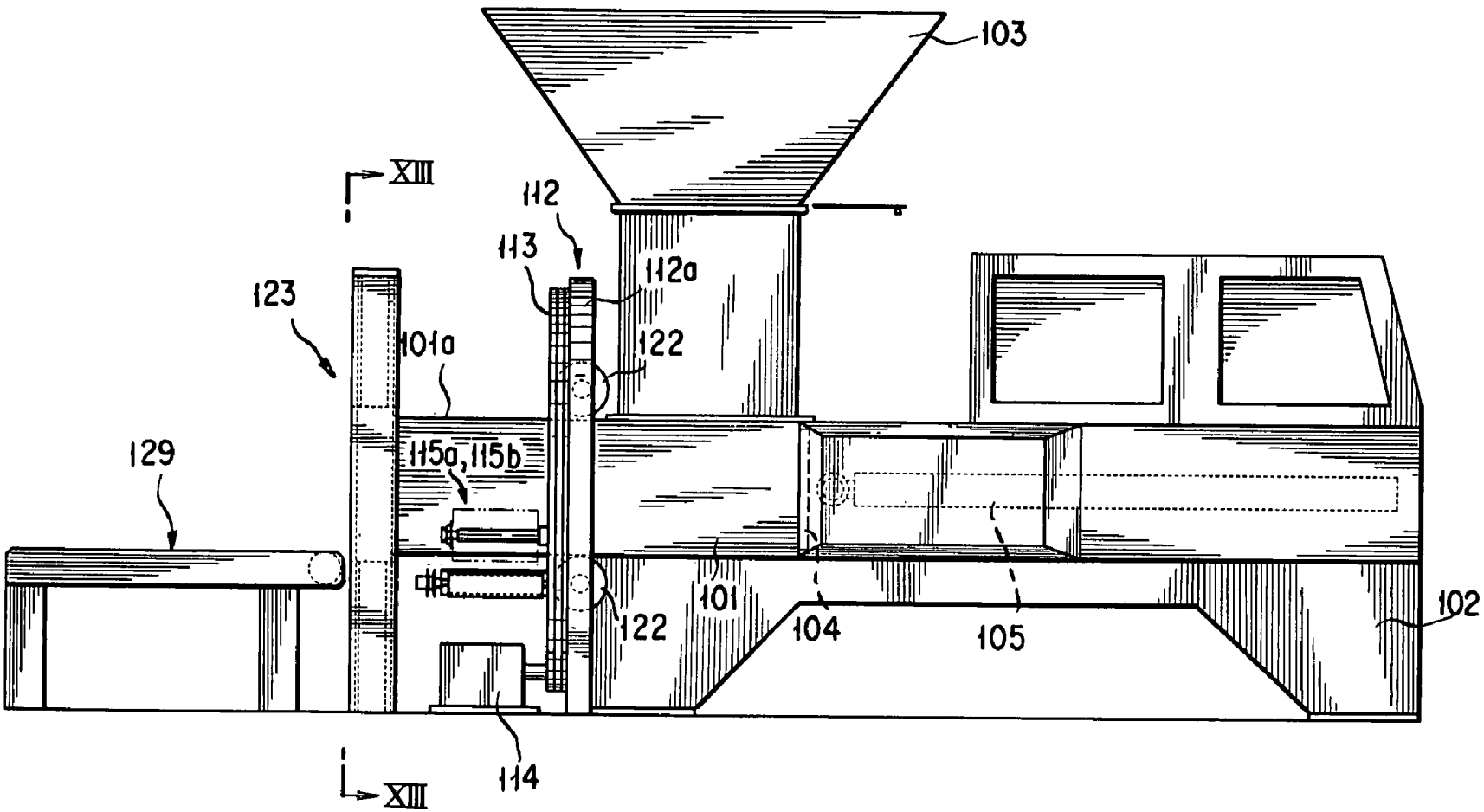
FIG. 11 is a side elevational view illustrating a second form of implementation of the load packaging apparatus according to the present invention.
Figure 12:
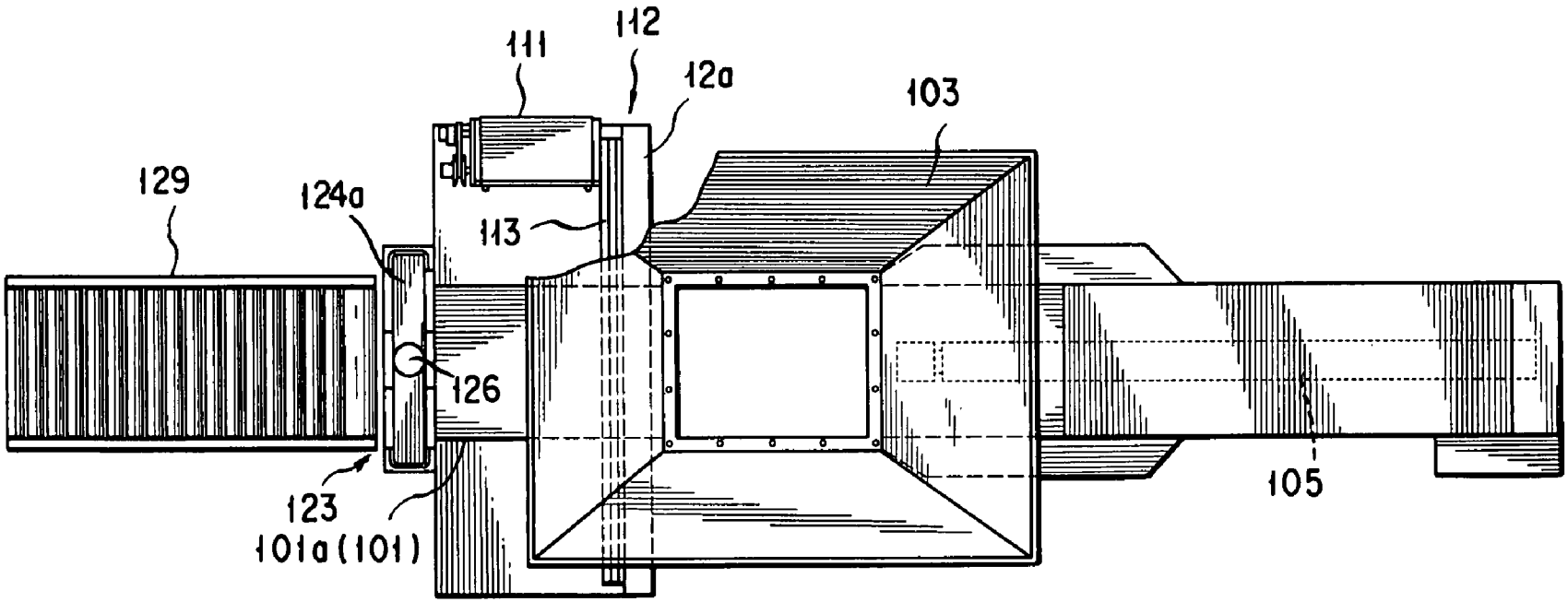
FIG. 12 is a top plan view illustrating the apparatus in the second form of implementation of the invention.

An explanation is next given of a second form of implementation of the present invention with reference to FIGS. 11 to 24. In FIGS. 11 and 12, a press cylinder 101 is shown mounted horizontally on a pedestal 102, and is shaped to be essentially square in cross section and to have its first end open. A hopper 103 is disposed above a base of the press cylinder 101. The press cylinder 101 has a press plate 104 slidably disposed therein to reciprocate between a location behind an opening of the hopper 103 to the press cylinder 101 and a location in front of its open end. Disposed behind the base of the press cylinder 101, a cylinder unit 105 is connected to the rear of the press plate 104.

Figure 14:
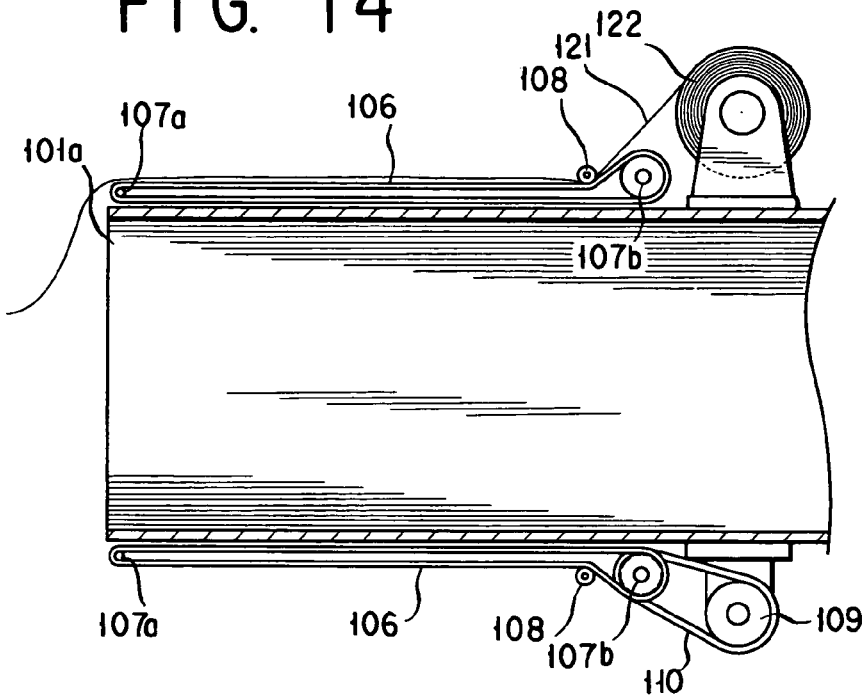
FIG. 14 is a cross sectional view of a portion of the apparatus taken along the line XIV—XIV in FIG. 13.

Ahead of the hopper 103, the press cylinder 101 terminates with a skirt section 101*a* having an axial length, which as shown in FIG. 14 has film feed conveyers 106 disposed on its four corner ridges, respectively, each over its full length, and each of the film feed conveyers 106 is wound in a loop over a pair of rotary wheels 107*a* and 107*b* supported by the skirt section 101*a*. Each film feed conveyer 106 is guided by the front (first) end side rotary wheel 107*a* and the rear side rotary wheel 107*b* and also by a guide wheel 108 disposed adjacent to the latter so that one half of its loop runs adjacent to the outer wall of the skirt section 101*a* and both halves of the loop extend essentially parallel to the skirt section 101*a*. The rear side rotary wheel 107*b* is coupled to the drive shaft of a drive motor 109 via a chain belt 110. Thus, all the film feed conveyers 106 are designed to have their loop outer halves running synchronously with one another axially with respect to the skirt section 101*a*. The film feed conveyers 106 may be driven by a common drive unit, or may be driven by four drive units, respectively.

Mounted above and below a base of the skirt section 101*a* of the press cylinder 101 and supported thereby are film rolls 122 and 122 from each of which a subsidiary film 121 having a width essentially identical to a side width of the skirt section 101*a* is to be unrolled and fed towards the end of the skirt section 101*a*.

Figure 13:
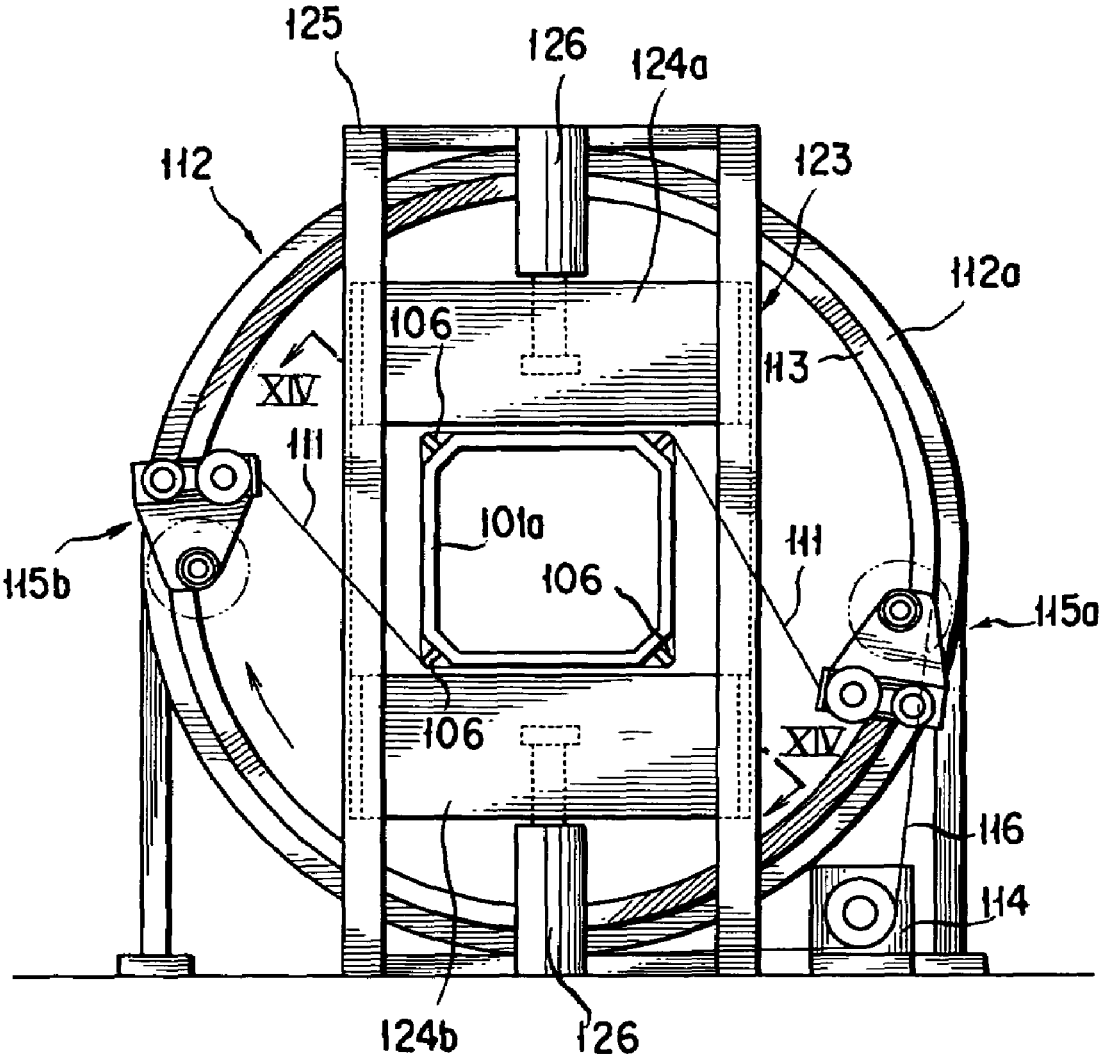
FIG. 13 is an enlarged front view of the apparatus in the second form of implementation of the invention.

Disposed so as to surround the skirt section 101*a* as shown in FIG. 13 is a ring shaped wrapping unit 112 for wrapping a stretch film 111, together with subsidiary films 121 carried from the film rolls 122, 122 by the film feed conveyers 106, around the skirt section 101*a*.

The ring shaped wrapping unit 112 comprises a ring frame 112*a* providing an axis of rotation essentially coaxial with the longitudinal axis of the skirt section 101*a*, a rotary ring 113 rotatably supported by the ring frame 112*a*, a drive motor 114 for rotationally driving the rotary ring 113, and a pair of film feeders 115*a* and 115*b* attached to the rotary ring 113 at diametrically opposite positions thereon.

Such a ring shaped wrapping unit 112 has been known per se, wherein the rotary ring 113 is adapted to be rotated by the drive motor 114 via a belt 116.

Figure 15:
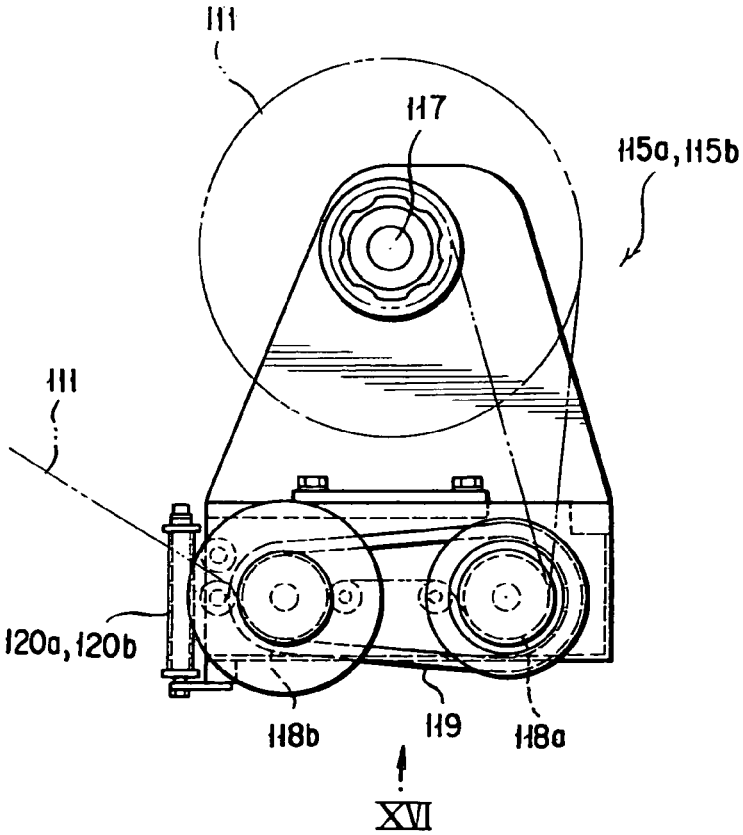
FIG. 15 is a front view illustrating a film feeder.
Figure 16:
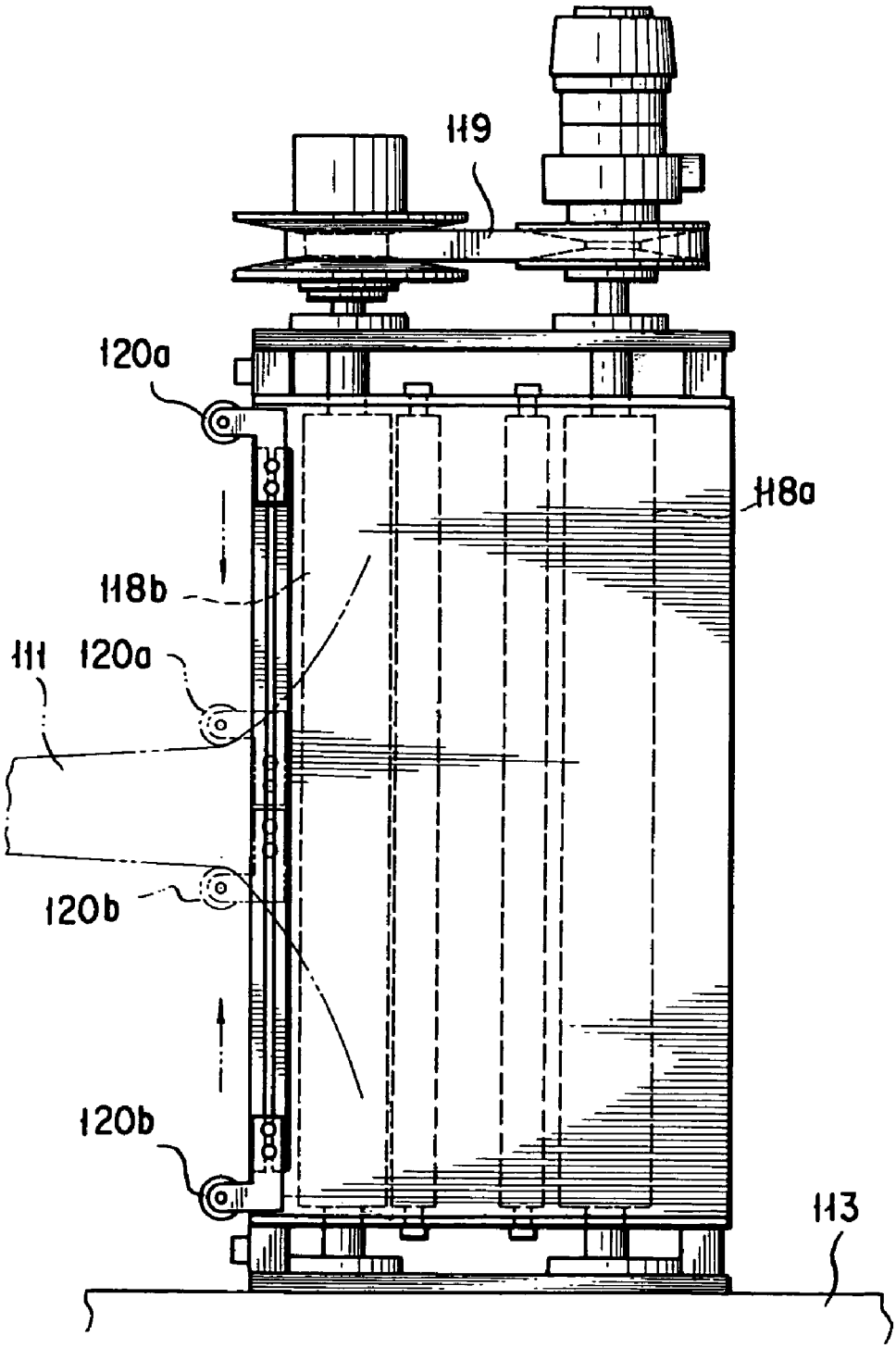
FIG. 16 is a view of the film feeder as viewed in the direction of the arrows XVI—XVI in FIG. 15.

As shown in FIGS. 15 and 16, each film feeder 115*a*, 115*b* includes a film supporting shaft 117 for supporting a roll of stretch film 111, and a pair of draw rollers 118*a* and 118*b*. Here, stretch film 111 is unrolled from the roll supported by the film supporting shaft 117 and is fed via the two draw rollers 118*a* and 118*b*. The two draw rollers 118*a* and 118*b* are rotated by the stretch film 111 being pulled out, and a difference in speed of rotation then caused between the two rollers 118*a* and 118*b* applies a strong stretching force to the film 111. In order to produce such a difference in speed of rotation, the two draw rollers 118*a* and 118*b* are coupled to a belt 119 via pulleys varying in diameter, and are rotated in an identical direction.

In addition, at least one of the two film feeders 115*a* and 115*b* is provided at the feed-out side of the outlet side draw roller 118*b* with a pair of mutually opposed squeeze rollers 120*a* and 120*b* which are positioned so that the spacing between them can be adjusted as desired at opposite sides of the width of the stretch film 111 being fed out. By these squeeze rollers 120*a* and 120, it is possible to change the width of the stretch film 111 being fed out of the film feeder 115*a*, 115*b*.

Disposed ahead of and adjacent to the open end of the skirt section 101*a* of the press cylinder 101 is a press cylinder blocking and unblocking door unit 123 for closing and opening the open end of the skirt section 101*a*. As shown in FIG. 13, the press cylinder blocking and unblocking door unit 123 comprises an upper and a lower door 124*a* and 124*b* each movable up and down, a pair of frames 125 in which the upper and lower doors 124*a* and 124*b* are fitted so that they may be moved slidably therein, and a pair of cylinder units 126 for moving the doors 124*a* and 124*b*, respectively, so as to open and close the open end of the skirt section therewith.

Thus, the skirt section 101*a* is closed or blocked by the doors 124*a* and 124*b* when they are driven to move vertically towards each other by the cylinder units 126 and then their opposing ends come into intimate contact with each other and their surfaces 124*c* and 124*d* on the side of the press cylinder 101 come into intimate contact with the open end 101*b* of the skirt section 101*a*. The skirt section 101*a* is likewise opened or unblocked by the doors 124*a* and 124*b* when they are driven to move away from each other and their surfaces 124*c* and 124*d* come apart from the open end 101*b*.

Figure 17:
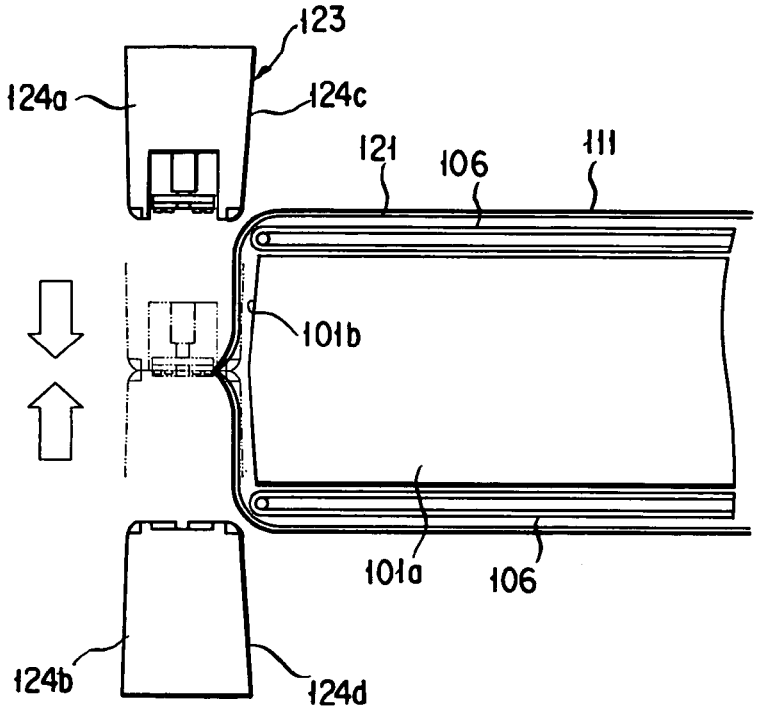
FIG. 17 is an explanatory view illustrating operations of film feed conveyers and a press cylinder blocking and unblocking door unit.

To this end, as shown in FIG. 17 each of the upper and lower halves of the open end 101*b* of the skirt section 101*a* is slightly slanted so that its side closer to the door end in its open state, namely its upper or lower side, is somewhat receded from its side closest to the door in its closed state, namely from its center point. The respective surfaces 124*c* and 124*d* of the upper and lower doors 124*a* and 124*b* in the press cylinder blocking and unblocking door unit 123 are each slightly slanted so they conform in inclination with those upper and lower halves of the open end 101*b* of the skirt section 101*a*, respectively, or so that they may come into intimate contact with those upper and lower halves of the open end 101*b* of the skirt section 101*a*.

Figure 18:
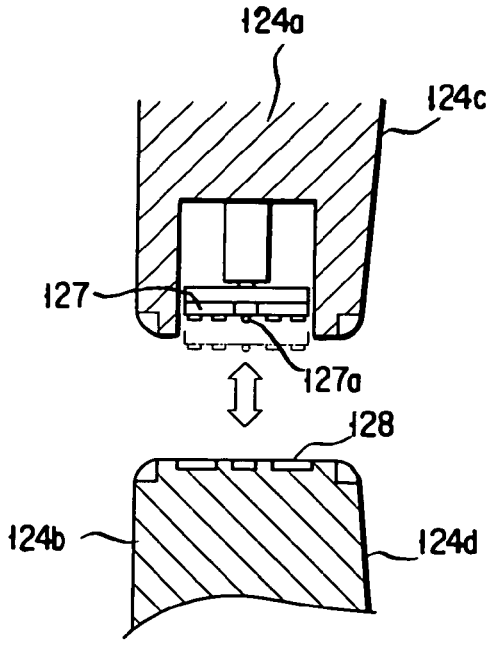
FIG. 18 is a cross sectional view illustrating a heat-sealing section in the press cylinder opening and closing door unit.

As shown in FIG. 18, a first one of the doors, 124*a* as shown, in the press cylinder blocking and unblocking door unit 123 is also provided at its end with a heat-sealing member 127 that is movable so as to rise and sink there and which, in turn, is provided at its center with a heated cutting wire 127*a*. Also, the second door 124*b* is provided at its end with a heat-sealing bearer 128 with which the heat-sealing member is to come into contact.

Disposed ahead of the press cylinder blocking and unblocking door unit 123 is a conveyer stand 129 whose height is set to be equal to or lower than the lower side of the press cylinder 101*a*.

A load packaging method using a load packaging apparatus constructed as mentioned above will be described below with reference to FIGS. 17 and 19A to 20B.

First, in the state in which the press cylinder blocking and unblocking door unit 123 is unblocking or open, subsidiary films 121 and 121 are pulled out of the film rolls 122 and 122 lying above and below the skirt section 101*a* of the press cylinder 101 to a length longer than that with which to close the open end of the skirt section 101*a*, whereupon their end portions are laid one on the other. Then, the film conveyers 106 on the four corner ridges of the skirt section 101*a* are driven so that their respective outer loop halves are moved towards the open end of the skirt section 101*a* while at the same time the ring shaped wrapping unit 112 is operated to cause the film feeders 115*a* and 115*b* to turn around the skirt section 1*a* so as to pull out stretch film 111 and to wrap it spirally around the skirt section 1*a*, from the outsides of the film feeding conveyers 106. This causes the stretch film 111 to be wrapped on the subsidiary films 121 as shown in FIG. 17.

The stretch film 111 thus wrapped around the skirt section 101*a* while becoming cylindrical in shape is moved forwards by the film feeding conveyers 106, and when the forward end of this cylindrical film 111 reaches ahead of the press cylinder blocking and unblocking door unit 123, the press cylinder blocking and unblocking door unit 123 is operated to close the doors 124*a* and 124*b*. While the doors 124*a* and 124*b* are being closed, the heat-sealing member 127 is moved to rise (extend outward) to thermally seal the forward end of the cylindrical film 111 and to cut it with the heated cutter wire 127*a*. At the same time, the upper and lower subsidiary films 121 and 121 located inside of the cylindrical film 111 are also thermally sealed (FIG. 17).

Figure 19A:
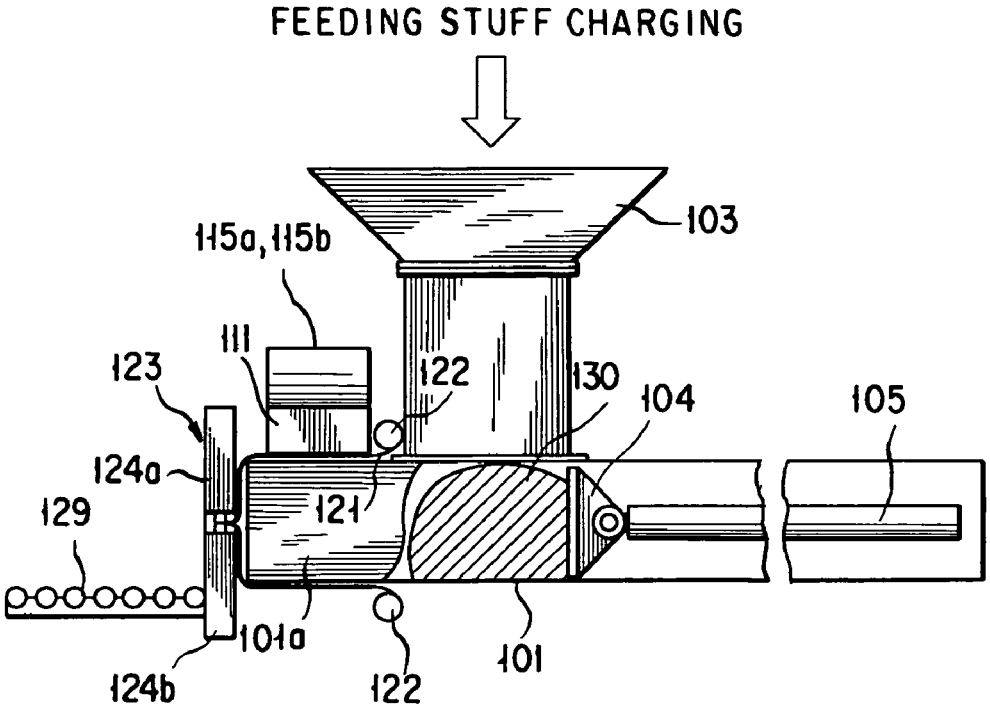
FIGS. 19A to 20B are explanatory views illustrating operations of the apparatus according to the second form of implementation of the invention.
Figure 19B:
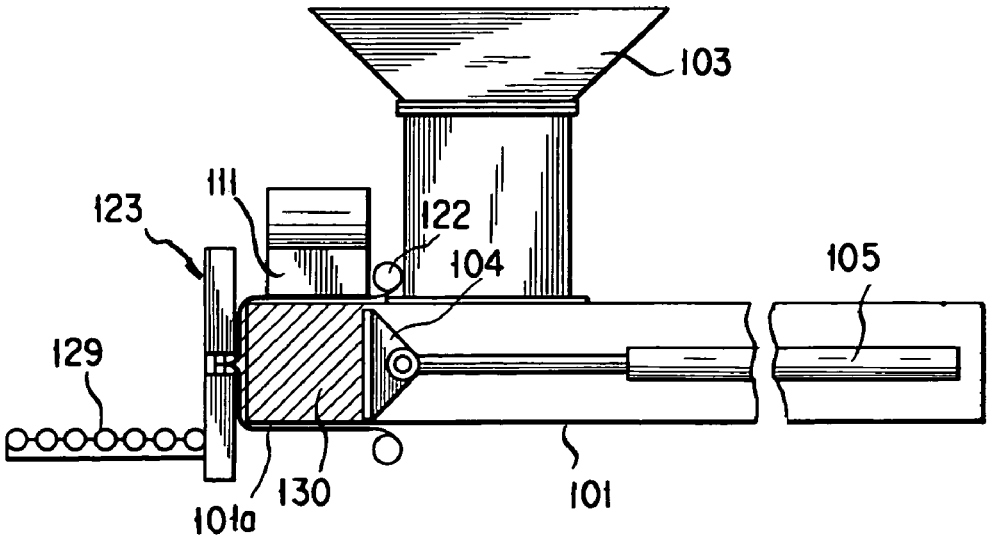

FIG. 19A shows this state, namely the state in which the open end of the skirt section 101*a* is closed by the press cylinder blocking and unblocking door unit 123 and by the wrapping films, and a state ready to commence wrapping a load material is then reached. Then, the press cylinder 101 is charged by means of the hopper 103 with a mass of bulk feeding stuff 130, and as shown in FIG. 19B the press plate 104 is reciprocated to press the feeding stuff 130 into the closed skirt section 101*a*. When this stage is reached, the operations of the film feeding conveyers 106 and the ring shaped wrapping unit 112 are suspended in order to suspend the film wrapping operation.

Figure 20A:
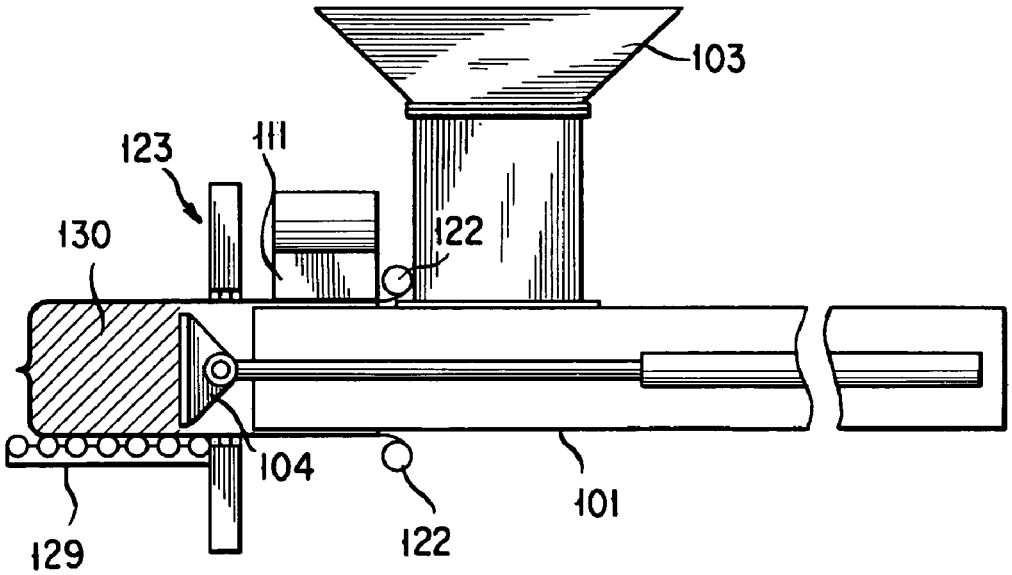

When the feeding stuff 130 is consolidated or compacted into a mass of a certain size in the skirt section 101*a*, the press cylinder blocking and unblocking door unit 123 is brought into the door opening state as shown in FIG. 20A to allow the mass of feeding stuff 130 to be thrust out of the press cylinder 101 onto the conveyer table 129 by the press plate 104. Then, the film feeding conveyers 106 and the ring shaped wrapping unit 112 are again operated to wrap the stretch film 111 around the skirt section 101*a* at a rate commensurate with that of thrust by the press plate 104. The subsidiary films 121 and 121 are also pulled out gradually.

Figure 20B:
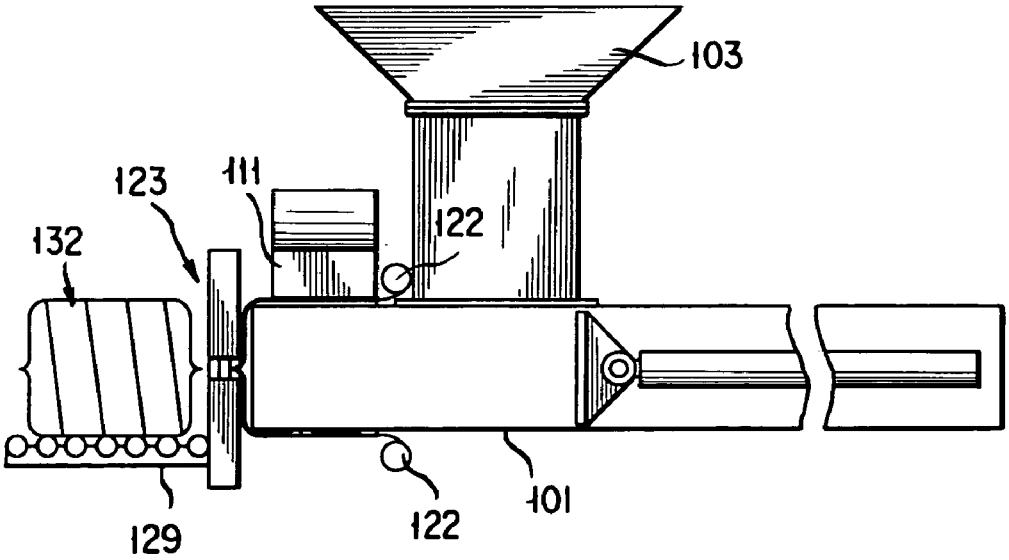

When the mass of feeding stuff thrust out by the press plate 104 is spaced enough away from the press cylinder blocking and unblocking door unit 123, the press plate 104 as shown in FIG. 20B is moved back behind the hopper 103 and then the press cylinder blocking and unblocking door unit 123 is operated to close the doors, thereby heat-sealing the wrapped film while severing it. In this stage, the stretch film 111 continues to be wrapped until an excess length of it is thrust out.

Figure 21:
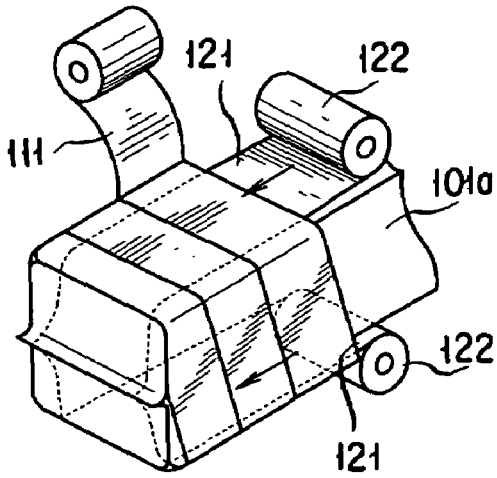
FIG. 21 is an explanatory view illustrating a manner in which a load material is wrapped with wrapping films comprising a stretch film and subsidiary films.

Wrapping the stretch film 111 and the subsidiary films 121 around the skirt section 101*a* is carried out as shown in FIG. 21.

Figure 22:
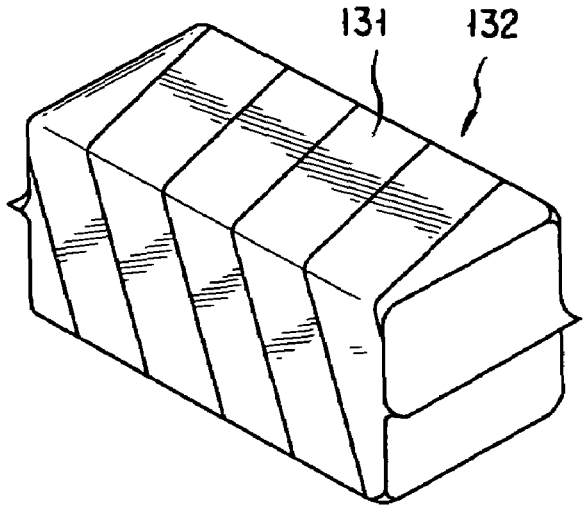
FIG. 22 is a perspective view illustrating the load material wrapped with the wrapping films.

The operations mentioned above complete yielding a package of material 132 as shown in FIG. 22, which is rectangular in cross section, has its longitudinal peripheral faces wrapped with the wrapping film 131 made of the stretch and subsidiary films 111 and 121, and has its longitudinally opposite end faces tightly sealed with the opposite ends of the cylindrical wrapping film 131 squeezed and closed. Repeating these operations allows yielding such packages 132 of material successively. Then, in yielding a package of material 132, the rate of rotation of the ring shaped wrapping unit 121 may be made adequately quicker with respect to the rate of feed of the film conveyers 106 to allow the stretch film 111 to be spirally wrapped around an unwrapped material in four to six turns.

The structure of a package 132 is characterized in that it has the upper and lower subsidiary films 121 and 121 inside of the stretch film 111 and its front and rear ends have the cylindrically wrapped stretch film 111 and the subsidiary films 121 and 121 each in the form of a band, the structure offering the advantage that the shell strength of the package is increased in its axial end faces compared with the case with the spiral stretch 111 alone, thus preventing bulge-deformation of these areas.

To mention further, the subsidiary films 121 may be omitted altogether if the packaging strength is not very essential or if a number of stretch films 111 are used.

Also, the structural feature that each of the halves of the open end 101*b* of the skirt section 101*a* is slightly slanted so that its side closer to the end of each door in its open state is somewhat receded from its side closer to the end of each door in its closed state and the respective surfaces 124*c* and 124*d* of the doors 124*a* and 124*b* in the press cylinder blocking and unblocking door unit 123 are each slightly slanted so they conform in inclination with those halves of the open end 101*b* of the skirt section 101*a*, respectively, allows the respective surfaces 124*c* and 124*d* of the doors 124*a* and 124*b* to come into intimate contact with those halves of the open end 101*b* of the skirt section 101*a* immediately before the door closure terminates and to detach from the open end 101*b* of the skirt section 101*a* immediately after the doors begin to be opened.

Thus, since the wrapped film lying opposed to the open end of the skirt section 101*a* is allowed to contact the doors 124*a* and 124*b* only while they are essentially in the closed state, the wrapped film is prevented from being damaged by their closing and opening operations.

Further, the structure whereby the closed doors 124*a* and 124*b* in the press cylinder blocking and unblocking door unit 123 are brought into pressure contact with the skirt section 101*a* at its open end 101*b* allows the skirt section 101 to be closed at its open end 101*b* with the doors 124*a* and 124*b* with an increased tightness.

Also, the film feed conveyers 106 in the state shown in FIG. 19A can be moved back to remove sagging of the closed wrapping film at its forward end.

Figure 23:
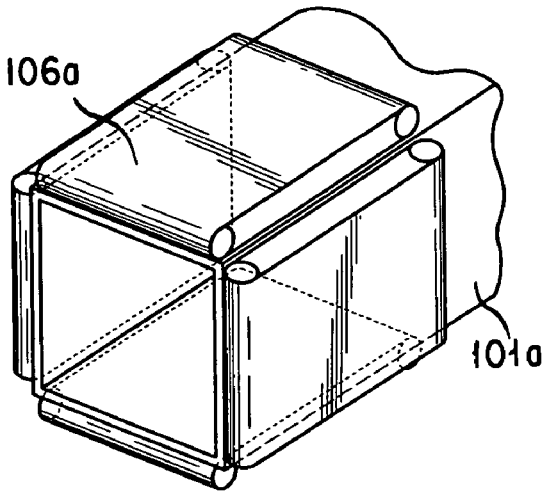
FIG. 23 is a perspective view diagrammatically illustrating another form of embodiment of the film feed conveyers.
Figure 24:
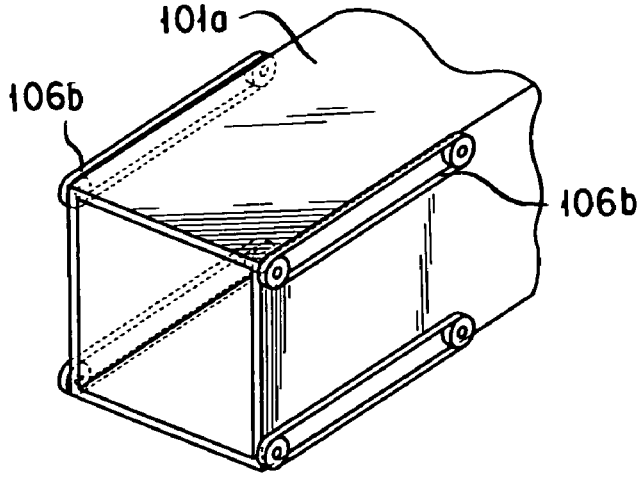
FIG. 24 is a perspective view diagrammatically illustrating yet another form of embodiment of the film feed conveyers.

Although in the second form of implementation of the invention mentioned above the film feed conveyers 106 are shown which are mounted on the four corner ridges of the skirt section 101*a*, respectively, they may be film feed conveyers 106*a*, each in the form of a band, which are mounted over four side faces of the skirt section 101*a*, respectively, as diagrammatically shown in FIG. 23. Alternatively, they may as shown in FIG. 24 be two pairs of film feed conveyers 106*b* of chain type which are mounted on two opposed side faces of the skirt sections 101*a*, respectively, the four film conveyers 106*b* being positioned immediately adjacent to the four corner ridges of the skirt sections 101*a* so that one loop half of each of them projects from other two opposed side surfaces of the skirt section 101*a*, respectively.

Also, while in the second form of implementation of the invention mentioned above the sealing of wrapped films by the press cylinder blocking and unblocking door unit is shown as performed by heat-sealing, this may be performed by sewing. To this end, the door 124*a* may be equipped with a sewing machine whereby the wrapped films are bound or stitched together in a pair of seams and may also be equipped with a cutter whereby the wrapped films are severed between the seams. Alternatively, the door 124*a* may be equipped with a tying unit whereby wrapped films are tied together at two places and also with a cutter whereby the wrapped films are severed between these tied places.

Further, the skirt section 101*a* of the press cylinder 101 need not necessarily be square in cross section but may, for example, be circularly cylindrical.

Also, the skirt section 101*a* may be covered with subsidiary films 121 not only along two opposed surfaces which are its upper and lower surfaces as shown but also along three or four side surfaces which are its upper, lower, and right and/or left hand side surfaces. Further, the subsidiary films 121 may be of cloth.

To mention further, a pair of doors 124*a* and 124*b* in the press cylinder blocking and unblocking door unit 123 mentioned above may alternatively be configured so that they are each swung in opening and closing directions.

Also, while in the first and second forms of implementation of the invention mentioned above the press cylinder, the press unit, the film feed conveyers, the ring-shaped wrapping unit and the cutting unit or the press cylinder blocking and unblocking door unit are shown mounted horizontally, they may be mounted vertically.

The invention claimed is:

1. A load packaging method, comprising:

wrapping a stretch film around a cylindrical skirt section in a direction orthogonal to a longitudinal axis of the skirt section, the stretch film being wrapped over a plurality of film feed conveyers spaced around the skirt section on corner ridges of the skirt section;

during said wrapping, moving the wrapped stretch film along the longitudinal axis of the skirt section and past an open end of the skirt section using the plurality of film feed conveyors, thereby forming a cylinder of wrapped stretch film;

during said moving of the wrapped stretch film, pushing a pressed load material within the skirt section out of the skirt section through the open end of the skirt section and into the cylinder of wrapped stretch film moved past the open end of the skirt section; and severing the wrapped stretch film at positions spaced apart from opposite ends of the pressed load material contained therein.

2. The method of claim 1, wherein the plurality of film feed conveyors are evenly spaced around the skirt section.

3. A load packaging apparatus comprising:

a press cylinder having a cylindrical skirt section with an open end;

a pressing device for axially pressing a load material within said press cylinder so as to push the load material in a forward direction and out of said open end of said skirt section;

a plurality of film feed conveyers spaced around said skirt section on corner ridges of said skirt section, respectively, and operable to move in the forward direction along a longitudinal axis of said skirt section towards said open end of said skirt section;

a ring-shaped wrapping device located outside of said skirt section for wrapping a stretch film around the skirt section in a direction orthogonal with respect to the longitudinal axis of said skirt section, and located outside of said film feed conveyers so that the stretch film is wrapped around said film feed conveyors while the wrapped stretch film is moved in the forward direction by said film feed conveyors so as to form a cylinder of wrapped stretch film; and a cutting device in front of said open end of said skirt section for acting on the cylinder of wrapped stretch film moved past said open end of said skirt section so as to sever the wrapped stretch film at a position spaced apart from said open end of said skirt section.

4. The apparatus of claim 3, wherein said plurality of film feed conveyors are evenly spaced around said skirt section.

5. A load packaging method, comprising:

wrapping a stretch film around a cylindrical skirt section in a direction orthogonal to a longitudinal axis of the skirt section, the stretch film being wrapped over a plurality of film feed conveyers spaced around the skirt section on corner ridges of the skirt section;

during said wrapping, moving the wrapped stretch film along the longitudinal axis of the skirt section and past an open end of the skirt section using the plurality of film feed conveyors, thereby forming a cylinder of wrapped stretch film;

during said moving of the wrapped stretch film, pushing a pressed load material within the skirt section out of the skirt section through the open end of the skirt section and into the cylinder of wrapped stretch film moved past the open end of the skirt section; and sealing the wrapped stretch film at opposite ends of the pressed load material contained therein.

6. The method of claim 5, wherein the plurality of film feed conveyors are evenly spaced around the skirt section.

7. A load packaging method, comprising:

feeding subsidiary films from at least two opposed peripheral sites on a cylindrical skirt section in a forward direction towards an open end of the skirt section;

wrapping a stretch film around the skirt section in a direction orthogonal to a longitudinal axis of the skirt section, the stretch film being wrapped over a plurality of film feed conveyers spaced around the skirt section on corner ridges of the skirt section, and over the subsidiary films;

during said feeding and said wrapping, moving the stretch film and the subsidiary films in the forward direction towards the open end of the skirt section using the plurality of film feed conveyors, thereby forming a cylinder of the wrapped stretch film and the subsidiary films;

during said moving of the cylinder of wrapped stretch film and the subsidiary films, pushing a pressed unpackaged load material within the skirt section through the open end of the skirt section and into the cylinder of wrapped stretch film and the subsidiary films; and sealing the cylinder of wrapped stretch film and subsidiary films at opposite ends of the load material contained therein.

8. The method of claim 7, wherein the plurality of film feed conveyors are evenly spaced around the skirt section.

9. A load packaging apparatus comprising:

a press cylinder having a cylindrical skirt section with an open end;

a pressing device for axially pressing a load material within said press cylinder so as to push the load material in a forward direction and out of said open end of said skirt section;

a plurality of film feed conveyers spaced around said skirt section on corner ridges of said skirt section, respectively, and operable to move in the forward direction along a longitudinal axis of said skirt section towards said open end of said skirt section;

a ring-shaped wrapping device located outside of said skirt section for wrapping a stretch film around the skirt section in a direction orthogonal with respect to the longitudinal axis of said skirt section, and located outside of said film feed conveyers so that the stretch film is wrapped around said film feed conveyors while the wrapped stretch film is moved in the forward direction by said film feed conveyors so as to form a cylinder of wrapped stretch film; and a press cylinder blocking-and-unblocking door device arranged to coincide in position with said open end of said skirt section, said press cylinder blocking-and-unblocking door device including a pair of doors for closing said open end of said skirt section, said doors having ends opposed to each other, and having at said opposed ends a sealing-and-cutting device for sealing the cylinder of wrapped stretch film moved from said open end of said skirt section and for severing the cylinder of wrapped stretch film at its sealed area.

10. The apparatus of claim 9, wherein said plurality of film feed conveyors are evenly spaced around said skirt section.

11. The apparatus of claim 9, further comprising at least two subsidiary film feeder devices located on at least two diametrically opposed peripheral areas of said skirt section, respectively, for feeding subsidiary films along the longitudinal axis of said skirt section towards said open end.

12. The apparatus of claim 11, wherein said two doors in said press cylinder blocking-and-unblocking door device are operable to move transverse to said open end of said skirt section and to close said open end, each half of said open end of said skirt section being slanted such that each of a top and bottom side of said open end is recessed from a center of said open end, and corresponding closing surfaces of said doors of said press cylinder blocking-and-unblocking door device are each slightly slanted so as to conform in inclination to said halves of said open end of said skirt section, respectively.

13. The apparatus of claim 9, wherein said two doors in said press cylinder blocking-and-unblocking door device are operable to move transverse to said open end of said skirt section and to close said open end, each half of said open end of said skirt section being slanted such that each of a top and bottom side of said open end is recessed from a center of said open end, and corresponding closing surfaces of said doors of said press cylinder blocking-and-unblocking door device are each slightly slanted so as to conform in inclination to said halves of said open end of said skirt section, respectively.

* * * * *